US006905301B2

(12) United States Patent
Tiemann

(10) Patent No.: US 6,905,301 B2
(45) Date of Patent: Jun. 14, 2005

(54) TURBINE BLADE/VANE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 346 days.

(21) Appl. No.: 10/214,760

(22) Filed: Aug. 9, 2002

(65) Prior Publication Data

US 2003/0035726 A1 Feb. 20, 2003

(30) Foreign Application Priority Data

Aug. 9, 2001 (EP) ..... 01119263

(51) Int. Cl.[7] ..... F01D 5/14

(52) U.S. Cl. ..... 415/115; 415/116; 416/97 R; 416/97 A

(58) Field of Search ..... 416/97 R, 97 A; 415/115, 116

(56) References Cited

U.S. PATENT DOCUMENTS

| | | | | |
|---|---|---|---|---|
| 3,475,107 A | | 10/1969 | Auxier | |
| 3,540,810 A | * | 11/1970 | Kercher | 416/90 R |
| 4,505,639 A | * | 3/1985 | Groess et al. | 416/97 R |
| 5,120,192 A | * | 6/1992 | Ohtomo et al. | 415/115 |
| 5,772,398 A | | 6/1998 | Noiret | |
| 5,820,336 A | * | 10/1998 | Hashimoto | 415/115 |
| 6,572,329 B2 | * | 6/2003 | Tiemann | 415/115 |

FOREIGN PATENT DOCUMENTS

| | | |
|---|---|---|
| DE | 1 916 588 | 11/1970 |
| DE | 1 601 553 | 12/1970 |
| EP | 0 911 486 | 4/1999 |
| GB | 1 467 483 | 3/1977 |
| JP | 56 191 827 | 6/1983 |
| JP | 59 047 545 | 10/1985 |

* cited by examiner

*Primary Examiner*—Hoang Nguyen
(74) *Attorney, Agent, or Firm*—Harness, Dickey & Pierce, P.L.C.

(57) ABSTRACT

A turbine blade/vane, having a blade/vane aerofoil which extends along a blade/vane axis and through which cooling medium flows, mainly in the longitudinal direction of the turbine blade/vane, is configured comparatively simply for reliable and effective closed cooling. In particular, it is configured with the use of cooling air as the cooling medium. An incident flow duct and an efflux duct for cooling medium are routed within the blade/vane aerofoil, essentially over its complete length. The incident flow duct and the efflux duct are connected together on the cooling medium side in such a way that cooling medium passing from the incident flow duct into the efflux duct is conducted in a transverse direction along a wall inner surface, which has to be cooled, of the blade/vane aerofoil.

30 Claims, 3 Drawing Sheets

TURBINE BLADE/VANE

The present application hereby claims priority under 35 U.S.C. §119 on European patent application number 01119263.0 filed Aug. 9, 2001, the entire contents of which are hereby incorporated by reference.

FIELD OF THE INVENTION

The invention generally relates to a turbine blade/vane. Preferably, it relates to one having a blade/vane aerofoil which extends along a blade/vane axis and through which cooling medium can flow, mainly in the longitudinal direction of the turbine blade/vane.

BACKGROUND OF THE INVENTION

Gas turbines are employed in many fields for driving generators or machinery. In this process, the energy content of a fuel is used to generate a rotational motion of a turbine shaft. For this purpose, the fuel is burnt in a combustion chamber, with compressed air being supplied from a air compressor. The working medium at high pressure and at high temperature generated by the combustion of the fuel in the combustion chamber is conducted, in this process, via a turbine unit connected downstream of the combustion chamber, where the gas expands with an output of work.

In order to generate the rotational motion of the turbine shaft in this process, a number of rotor blades, which are usually combined into blade groups or blade rows, are arranged on this turbine shaft and these rotor blades drive the turbine shaft via a transfer of inertia from the flow medium. In order to conduct the flow medium within the turbine unit, furthermore, guide vane rows connected to the turbine casing are usually arranged between adjacent rotor blade rows. The turbine blades/vanes, in particular the guide vanes, usually have a blade/vane aerofoil extending along a blade/vane axis to appropriately conduct the working medium. A platform extending transverse to the blade/vane axis can be formed at the end of the blade/vane aerofoil for fastening the turbine blade/vane to the respective support body.

In the design of such gas turbines, a usual design objective—in addition to the achievable power—is a particularly high efficiency. For thermodynamic reason, an increase in the efficiency can fundamentally be obtained by increasing the outlet temperature with which the working medium flows out of the combustion chamber and into the turbine unit. In consequence, temperatures of approximately 1200° C. to 1300° C. are an objective for such gas turbines and are also achieved.

In the case of such high temperatures of the working medium, however, the components and structural parts exposed to this working medium are subjected to high thermal stresses. In order, nevertheless, to ensure a comparatively long life of the components affected at a high level of reliability, cooling is usually provided for the components affected, in particular for the rotor blades and/or guide vanes of the turbine unit. The turbine blades/vanes are therefore usually designed so that they can be cooled, it being particularly necessary to ensure an effective and reliable cooling of the first blade/vane, viewed in the flow direction of the working medium. For cooling purposes, the respective blades/vanes in this arrangement usually have a cooling medium duct, which is integrated into the blade/vane aerofoil or the blade/vane profile and from which a cooling medium can be specifically conducted to the thermally stressed zones, in particular, of the turbine blade/vane.

In this arrangement, cooling air is usually employed as the cooling medium. This cooling air is usually supplied to the respective turbine blade/vane, in the manner of an open cooling system, via an integrated cooling medium duct. After emerging from the turbine blade/vane, the cooling air is then mixed with the working medium conducted within the turbine unit. The design power of a gas turbine cooled in this manner is, however, limited, particularly because—in view of the limited mechanical load-carrying capability of individual components of the gas turbine—a further increase in power is usually only achievable by an increased supply of fuel. This, in turn, involves a relative increase in the cooling medium requirement for cooling the turbine blades/vanes, which in turn signifies losses in the available compressor mass flow. These losses can, in turn, only be accepted to a limited degree. In gas turbines, furthermore, it can be necessary, in view also of a necessary level of security, to prevent mixing of cooling medium flowing out of the turbine blade/vane with a working medium flowing through the turbine unit.

SUMMARY OF THE INVENTION

An embodiment of the invention is based on an object of providing a turbine blade/vane for which, using comparatively simple devices, a reliable and effective closed cooling system is made possible. In particular, it can be done with the use of cooling air as the cooling medium.

An object may be achieved, according to an embodiment of the invention, in that an incident flow duct and an efflux duct for cooling medium can be routed within the blade/vane aerofoil, essentially over its complete length. Further, the incident flow duct and the efflux duct may be connected together on the cooling medium side in such a way that cooling medium being transferred from the incident flow duct into the efflux duct can be conducted in a transverse direction along a wall inner surface, which has to be cooled, of the blade/vane aerofoil.

An embodiment of the invention can therefore be based on a consideration that effective cooling of a turbine blade/vane may, in particular, be achieved by using an area exposure to cooling medium of the wall surface, which has to be cooled, of the blade/vane aerofoil. It has been recognized that such an area exposure uses a targeted conduction of the cooling medium to the wall surface and a conduction of the cooling medium along the wall surface. This can be achieved by respectively providing a separate incident flow duct and a separate efflux duct for cooling medium. On the basis of this division of the cooling medium duct into two parts, the exposure of the wall surface, which has to be cooled, of the blade/vane aerofoil may take place in such a way that the cooling medium is conducted in a transverse direction in the course of its transfer from the incident flow duct into the efflux duct.

The conduction of the cooling medium, principally in the longitudinal direction of the blade/vane aerofoil permits the maintenance of particularly short, and therefore loss-reducing, flow paths for the flow of the cooling medium. This principal flow direction is only altered into a transverse direction in the region in which such a change is useful for targeted and effective cooling. In this way, unavoidable flow losses are kept to a low level. Exposing the blade/vane aerofoil to a comparatively large quantity of cooling medium is not, furthermore, prevented by limitations in the flow path. It is of particular advantage that a high cooling performance may be brought about in a targeted manner in a comparatively small section of the flow path of the cooling medium, i.e. mainly in the course of that section of its path which is arranged in the direction transverse to the blade/vane aerofoil during the transfer from the incident flow duct into the efflux duct.

At selected locations, which are associated with thermally particularly highly stressed regions of the blade/vane aerofoil, the incident flow duct can have outlet openings for transferring cooling medium into the efflux duct. It is, however, particularly advantageous for the incident flow duct to have cooling medium outlet openings which are approximately uniformly distributed over the length of the turbine blade/vane and face toward the wall inner surface, which has to be cooled, of the blade/vane aerofoil. In this way, area cooling of the blade/vane aerofoil can be achieved particularly simply. The cooling can then take place by use of so-called impingement cooling, with a wall of the incident flow duct, which exhibits the outlet openings, being used as an impingement cooling wall, by which cooling medium meeting it comes into intensive contact and can be subsequently conducted away via the outlet openings for transfer into the efflux duct.

In order to achieve a uniform flow of the cooling medium and to utilize the space available in the blade/vane aerofoil in the most targeted manner possible, the free cross section of the incident flow duct in the blade/vane aerofoil preferably decreases in the longitudinal direction of the latter. This takes account of the fact that, during the course of the incident flow duct, an increasing part of the cooling medium has already left the incident flow duct and has been transferred into the efflux duct.

Particularly in the case where the area exposure to cooling medium is uniform over the length of the blade/vane aerofoil, it is particularly advantageous, for simple embodiment of the turbine blade/vane, for the free cross section of the incident flow duct in the blade/vane aerofoil to decrease linearly in the longitudinal direction of the latter. In this case, the incident flow duct can, for example, be formed very simply from flat sheet-metal plates. In the interest of a uniform, free volume flow of cooling medium through the turbine blade/vane, the free cross section of the efflux duct in the blade/vane aerofoil increases in the longitudinal direction of the latter to correspond with the decrease in the free cross section of the incident flow duct.

To the extent that the cooling medium leaves the incident flow duct, the free cross section of the incident flow duct is reduced and, at the same time, the free cross section of the efflux duct, for the cooling medium which is flowing out, is increased to a corresponding extent. By this, the cooling medium being transferred into the efflux duct in the course of the latter can, in addition, be effectively removed without any hindrance.

A very simple construction of the incident flow duct and/or efflux duct, made up from flat plates for example, can be achieved if, in accordance with an advantageous development, the incident flow duct and/or the efflux duct include a triangular cross section parallel to the longitudinal direction of the blade/vane aerofoil and at right angles to the wall inner surface, which has to be cooled, of the blade/vane aerofoil.

Because all the wall surfaces of the blade/vane aerofoil of the turbine blade/vane are not usually subjected to the same thermal stresses, it can be sufficient to provide only one incident flow duct for cooling a particularly severely thermally stressed wall surfaces in the turbine blade/vane. In particular, however, where both the pressure surface and the suction surface of the turbine blade/vane have to be cooled, it is advantageous to provide a second incident flow duct for cooling medium for cooling a further wall inner surface of the blade/vane aerofoil, which incident flow duct is arranged symmetrically, with respect to the blade/vane axis, relative to the first incident flow duct. Because, in this arrangement, the wall inner surfaces to be cooled are arranged opposite to one another, the first incident flow duct and the second incident flow duct preferably open into a common efflux duct for cooling medium. The efflux duct can, for example, expediently extend in a central region of the blade/vane aerofoil.

The conduction of the cooling medium along the wall inner surface, which has to be cooled, of the blade/vane aerofoil in the transverse direction thereof takes place in a manner which is even more targeted and increases the cooling effect even more if, according to another advantageous development, the or—in the case of a plurality of wall inner surfaces to be cooled—each wall inner surface, which has to be cooled, of the blade/vane aerofoil is respectively provided with ribs, which are arranged transversely to the blade/vane axis and guide the cooling medium. These ribs have, furthermore, an additional cooling rib effect as a result and therefore further improve the cooling.

The incident flow duct is advantageously closed at its end remote from an inlet area for cooling medium and/or the efflux duct is closed at its beginning remote from an outlet area for cooling medium. This permits a simple construction and disturbance-free supply and removal of the cooling medium to and from the turbine blade/vane.

In the case, for example, of turbine blades/vanes which have a platform extending transversely to the blade/vane axis—in particular for joining the turbine vanes to the turbine casing—and in which cooling of the platform is also desirable for reasons of high thermal stress, it can however be favorable to deviate from the constructional principle previously described. A turbine blade/vane can be advantageous in which a platform, which extends transversely to the blade/vane axis, is formed on the blade/vane aerofoil at its cooling medium efflux end, wherein the platform includes a cooling chamber which is joined to the incident flow duct and to which cooling medium can be admitted. In this way, the incident flow duct which supplies cooling medium to the wall inner surface, which has to be cooled, of the blade/vane aerofoil can be simultaneously used as a cooling medium supply duct to the cooling chamber of the platform, thus substantially simplifying the structural shape of the turbine blade/vane. Of just such an advantage is a turbine blade/vane in which a platform, which extends transversely to the blade/vane axis, is formed on the blade/vane aerofoil at its cooling medium incident flow end, which platform has a cooling chamber, which is joined to the efflux duct and to which cooling medium can be admitted. In this arrangement, the cooling medium employed for cooling the platform can be removed directly from the turbine blade/vane without complicated return ducts having to be provided or without the danger of mixing with cooling medium which is provided for cooling the wall inner surface of the blade/vane aerofoil. The effective cooling of the blade/vane aerofoil is therefore not endangered.

For a particularly small requirement with respect to manufacture of the turbine blade/vane, the or each cooling chamber can be advantageously cast into the respective platform and can be closed toward the outside by a cover panel. In this way, the cooling chamber can be directly manufactured when casting the turbine blade/vane so that no subsequent machining of the casting is necessary. In this arrangement, it is only necessary to attach the respective cover panel in order to reliably close the respective cooling chamber off from the outside.

Particularly reliable cooling of the respective structural parts, using cooling medium, can be achieved by use of impingement cooling. For this purpose, the or each cooling chamber can be advantageously provided, in a floor area, with a sheet-metal impingement cooling panel arranged at a distance from the chamber floor. In this arrangement, the impingement cooling panel can be essentially configured as a perforated panel, the cooling medium meeting the impingement cooling panel being in particularly intensive contact with the latter; it can be subsequently conducted away via the perforation.

In a further advantageous configuration of this arrangement for reliable cooling medium removal, an efflux space of the cooling chamber, which is bounded by the chamber floor and the impingement cooling panel, can be joined to the efflux duct. Correspondingly, for a reliable supply of cooling medium to the cooling chamber, and according to another advantageous further development, an incident flow space of the cooling chamber, which is bounded by the cover panel and the impingement cooling panel, can be joined to the incident flow duct.

The turbine blade/vane can be advantageously configured as a guide vane for a gas turbine, in particular for a stationary gas turbine.

Advantages achieved by various embodiments of the invention include, in particular, the fact that due to the provision of an incident flow duct and an efflux duct in the turbine blade/vane, the cooling medium can be conducted along the inside of the turbine blade/vane in a transverse direction during transfer from the incident flow duct into the efflux duct so that an area exposure of the blade/vane aerofoil is made possible and particularly effective cooling takes place. In this arrangement, the turbine blade/vane can be manufactured with comparatively little complication, a particularly important feature being that the incident flow duct and the efflux duct can be configured as simple inserts, which can be fitted into the blade/vane aerofoil. An inclusion of closed cooling concepts using air as the cooling medium is, in addition, made possible in a comparatively simple manner.

BRIEF DESCRIPTION OF THE DRAWINGS

An exemplary embodiment of the invention is explained in more detail using the drawings, wherein.

Identical parts are provided with the same designations in all the figures.

DETAILED DESCRIPTION OF THE PREFERRED EMBODIMENTS

Figure 1:
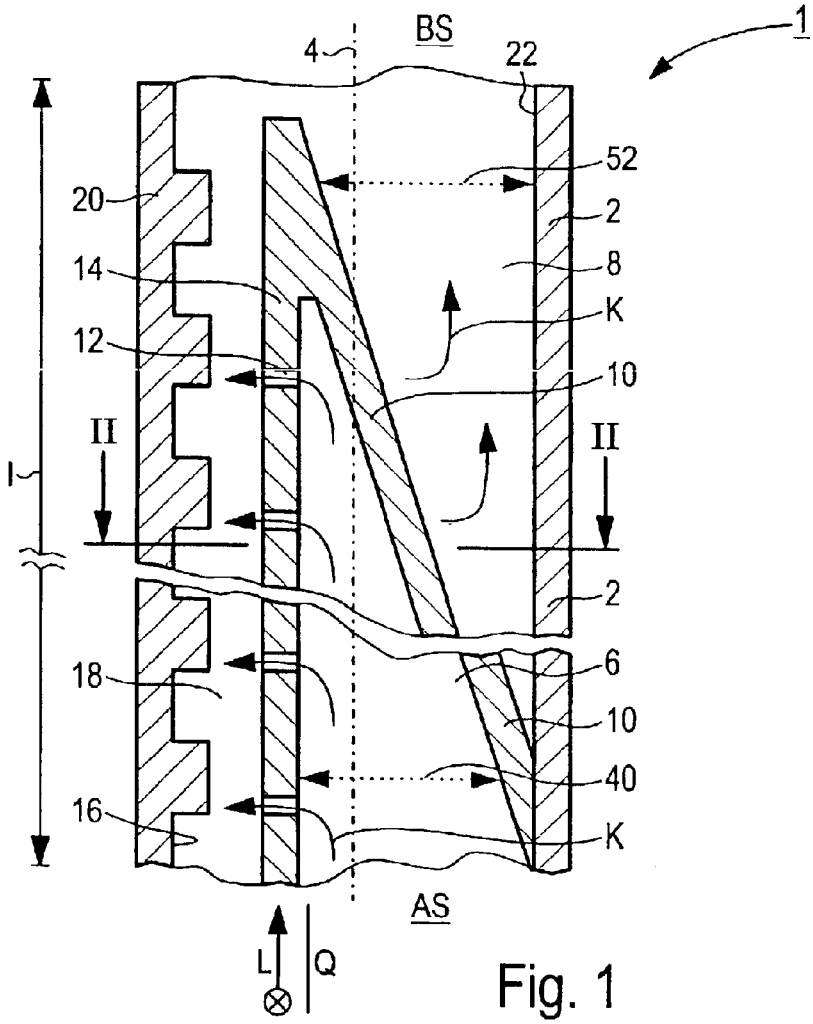
FIG. 1 shows a turbine blade/vane in a partial longitudinal section.

The turbine blade/vane shown in FIG. 1 has a blade/vane aerofoil 2 which extends along a blade/vane axis 4. In order to appropriately influence a working medium flowing in an associated turbine unit, the blade/vane aerofoil 2 is domed and/or curved.

The turbine blade/vane 1 is configured as a guide vane for a gas turbine (not shown here in any more detail) and is configured, in the manner of a closed cooling system, as a turbine blade/vane which can be cooled using cooling air as the cooling medium. For this purpose, cooling medium K can flow through the blade/vane aerofoil 2, principally in its longitudinal direction L, the cooling medium K entering into the blade/vane aerofoil 2 from a cooling medium incident flow end AS and emerging again from the blade/vane aerofoil at a cooling medium efflux end BS.

An incident flow duct 6, into which cooling medium K can enter from the cooling medium incident flow end AS, and an efflux duct 8 for cooling medium K are routed within the blade/vane aerofoil 2, essentially over its complete length l. The cooling medium can leave the blade/vane aerofoil 2 again via the efflux duct 8 at the cooling medium efflux end BS. The incident flow duct 6 is bounded, on one side, by a flat, closed wall 10, which extends diagonally within the blade/vane aerofoil 2 and, on the other side, by a flat wall 14, which has outlet openings 12 for cooling medium K; the closed wall 10 and the wall 14 with the outlet openings 12 can be formed by sheet-metal plates. The wall 14 which has the outlet openings 12, which are distributed approximately uniformly over the length l of the incident flow duct 6, is arranged parallel to a wall inner surface 16, which has to be cooled, of the blade/vane aerofoil 2, so that a transfer duct 18 is configured between this wall inner surface 16 and the previously mentioned wall 14 of the incident flow duct 6.

In the transfer duct 18, cooling medium K, which is transferred from the incident flow duct 6 into the efflux duct 8, is conducted in a transverse direction Q of the blade/vane aerofoil 2 along the wall inner surface 16, which has to be cooled, of the blade/vane aerofoil 2. Ribs 20, which extend in the transverse direction Q of the blade/vane aerofoil 2, are arranged on this wall inner surface 16 and these ribs 20 contribute to determining the flow direction of the cooling medium K which is being transferred and, furthermore, they are also used as cooling ribs for the blade/vane aerofoil 2.

After the cooling medium has flowed along the wall inner surface 16 of the blade/vane aerofoil 2, while cooling the inner wall surface 16, it enters the efflux duct 8. The efflux duct 8 is bounded, on one side, by the flat, closed wall 10, which extends diagonally within the blade/vane aerofoil 2 and separates the incident flow duct 6 from the efflux duct 8. Further, on the other side, it is bounded by a wall inner surface 22 of the blade/vane aerofoil 2, which is opposite to the wall inner surface 16 which has to be cooled.

The arrangement is selected in such a way that the free cross section 40 of the incident flow duct 6 decreases linearly within the blade/vane aerofoil 2 in the longitudinal direction L of the latter. At the same time, the free cross section 52 of the efflux duct 8 increases within the blade/vane aerofoil 2 in the longitudinal direction L of the latter to match this decrease in the incident flow duct 6. In addition, both the incident flow duct 6 and the efflux duct 8 have a triangular cross section parallel to the longitudinal direction L of the blade/vane aerofoil 2 and at right angles to the wall inner surface 16 which has to be cooled.

Figure 2:
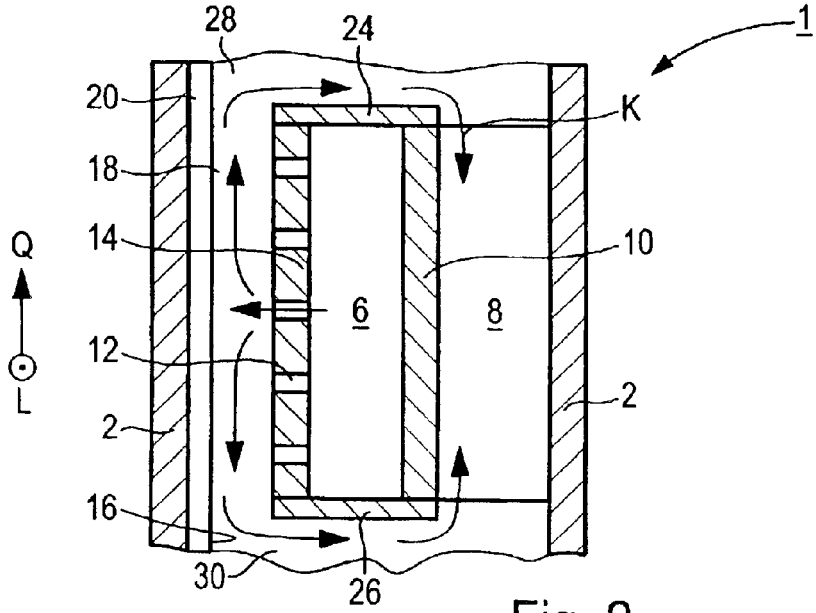
FIG. 2 shows a cross section through the turbine blade/vane of FIG. 1.

FIG. 2, which represents a cross section along the line II—II through the turbine blade/vane of FIG. 1, makes the transfer of the cooling medium K from the incident flow duct 6 to the efflux duct 8 particularly clear. In addition to the wall 14, which has the outlet openings 12 and faces toward the wall inner surface 16, which has to be cooled, of the blade/vane aerofoil 2 and the closed wall 10 opposite to it, the incident flow duct 6 has two further walls 24, 26, which connect the last-mentioned walls 10, 14, so that the incident flow duct 6 is closed with the exception of an inlet area and the outlet openings 12. In this arrangement, the further walls 24, 26 can also be respectively formed by a sheet-metal plate.

The cooling medium K flowing into the incident flow duct 6 in the longitudinal direction L of the blade/vane aerofoil 2 leaves this duct via the outlet openings 12 and then impinges on the wall inner surface 16 of the blade/vane aerofoil 2. This provides an impingement cooling effect which is further enhanced by the fact that the cooling medium K—additionally guided by ribs 20—is led along the wall inner surface 16 of the blade/vane aerofoil 2 in the transverse direction Q of the latter and, in the process, reaches the efflux duct 8 through transfer ducts 18, 28, 30; in this process, the cooling medium K flows around at least a part of the incident flow duct 6 and then reaches the efflux duct 8, through which, in turn, it flows away in the longitudinal direction of the blade/vane aerofoil 2. Because of the ribs 20 arranged on the wall inner surface 16 of the blade/vane aerofoil 2, there is a cooling rib effect which enhances the cooling action.

Figure 3:
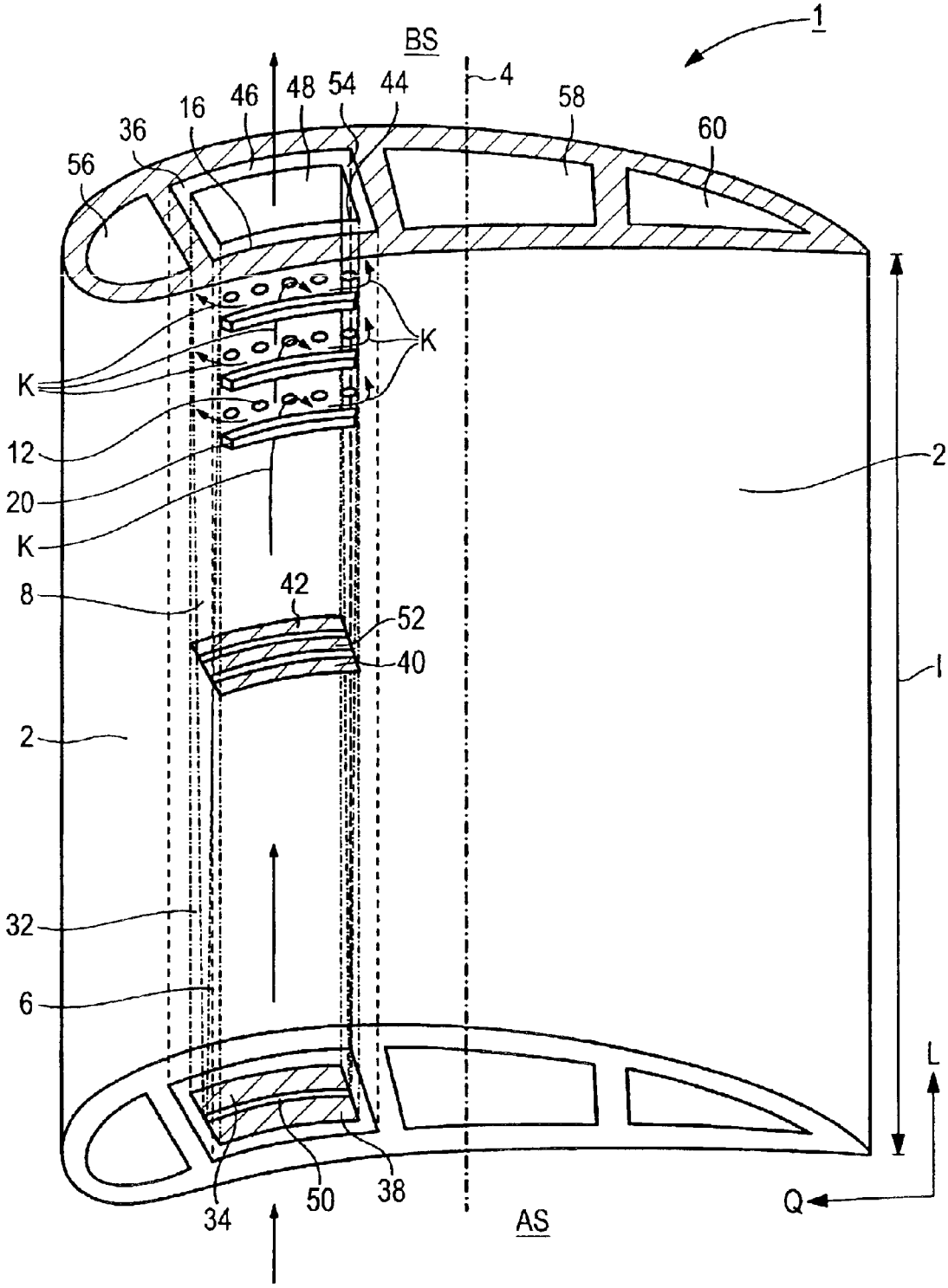
FIG. 3 shows another turbine blade/vane in a partially sectioned perspective view and FIG. 4 shows a further turbine blade/vane in a longitudinal section.

FIG. 3 shows, in a partially sectioned perspective view, another turbine blade/vane 1 with a blade/vane aerofoil 2. In this case, the blade/vane aerofoil 2 has a first incident flow duct 6 and a second incident flow duct 32 for cooling medium K, the incident flow ducts 6, 32 being arranged symmetrically relative to one another with respect to the blade/vane axis 4 and passing through the blade/vane aerofoil 2 over a length l in its longitudinal direction L. Cooling medium K enters the incident flow ducts 6, 32 at the cooling medium incident flow end AS of the blade/vane aerofoil 2, flows through the blade/vane aerofoil 2 in its longitudinal direction L in both incident flow ducts 6, 32 and leaves the latter via outlet openings 12 which, for reasons of clarity, are only shown in the first incident flow duct 6 in FIG. 3. The cooling medium K then flows in a transverse direction Q extending at right angles to the longitudinal direction L of the blade/vane aerofoil 2 along respective wall inner surfaces 16, 36, which have to be cooled, of the blade/vane aerofoil 2. These wall inner surfaces 16, 36 are arranged opposite the outlet openings 12 of the incident flow ducts 6, 32 and have ribs 20—only shown, for reasons of clarity, on the first wall inner surface 16 which has to be cooled in FIG. 3—provided for guiding the cooling medium K. The flow along the wall inner surfaces 16, 36, which have to be cooled, takes place during a transfer of the cooling medium K from the incident flow ducts 6, 32 into a common efflux duct 8 for cooling medium K, which efflux duct 8 is arranged centrally between the incident flow ducts 6, 32. The cooling medium K is supplied, via the efflux duct 8, in the longitudinal direction L of the blade/vane aerofoil 2 to its cooling medium efflux end BS.

At the cooling medium incident flow end AS of the blade/vane aerofoil, the incident flow ducts 6, 32 have respective free cross sections of the same size and these form inlet areas 34, 38. There free cross sections of the incident flow ducts 6, 32 decrease linearly in the blade/vane aerofoil 2 in its longitudinal direction L so that, at half length ½, the free cross sections 40, 42 have likewise been respectively halved, provided the incident flow ducts 6, 32 have no free cross section at their ends 44, 46 remote from the inlet areas 34, 38 for cooling medium K. At the same time, this means that the incident flow ducts are closed at these ends 44, 46 in each case.

On the other hand, the efflux duct 8 is closed at its start 50 remote from an outlet area 48, for cooling medium K, formed by a free cross section and the efflux duct 8 has no free cross section there. In its longitudinal direction L, the free cross section of the efflux duct 8 in the blade/vane aerofoil 2 increases to correspond with the decrease in the free cross section of the incident flow ducts 6, 32. At half length ½ of the blade/vane aerofoil 2, therefore, the free cross section 52 of the efflux duct 8 has an area which corresponds to the sum of the free cross sections 40, 42 of the incident flow ducts 6, 32 at this location. This guarantees a free efflux of the cooling medium K.

In addition to a recess 54, which extends in longitudinal direction L and in which the incident flow ducts 6, 32 and the efflux duct 8 are arranged, the blade/vane aerofoil 2 has further recesses 56, 58, 60 which extend in the longitudinal direction L. The last-named recesses 56, 58, 60, which are shown in FIG. 3 as cavities, can likewise be provided with corresponding incident flow ducts and efflux ducts for cooling medium and can be used for cooling the turbine blade/vane 1.

Figure 4:
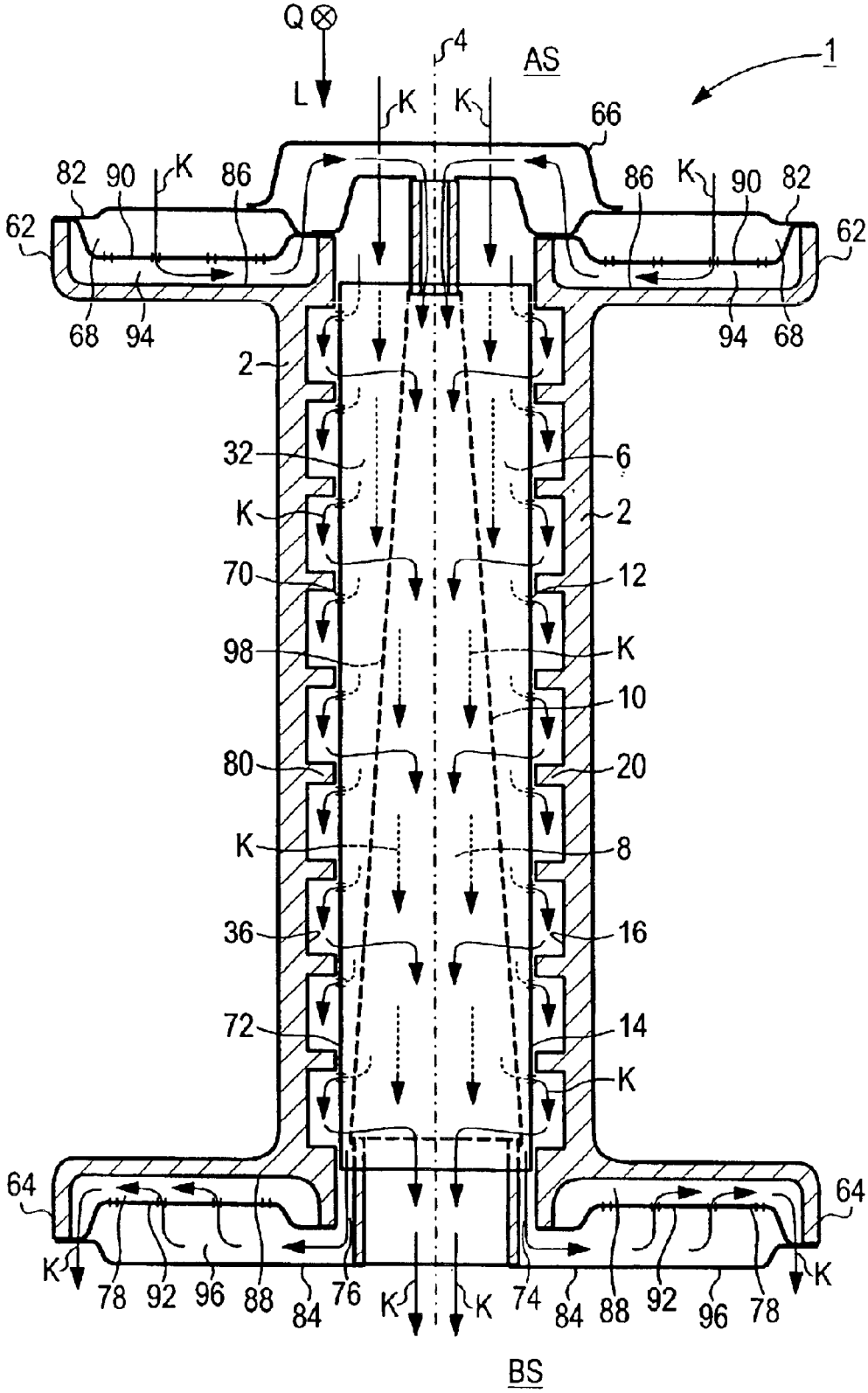

FIG. 4 shows, in a longitudinal section, a further turbine blade/vane 1 which can, in particular, be a guide vane for a gas turbine with a blade/vane aerofoil 2 having two incident flow ducts 6, 32 for cooling medium K symmetrically arranged about a blade/vane axis 4. A first platform 62, which extends transversely to the blade/vane axis 4 and which forms a cap plate, is formed on the blade/vane aerofoil 2 at a cooling medium incident flow end AS. A second platform 64, which extends transversely to the blade/vane axis 4 and forms a root plate, is formed on a cooling medium efflux end BS. At the cooling medium incident flow end AS, cooling medium K enters the first platform 62 and into a central region of the blade/vane aerofoil 2, which is screened by a cover panel 66 and connected to the incident flow ducts 6, 32. In this arrangement, a cooling chamber 68 of the first platform 62 is joined onto the efflux duct 8 so that cooling medium K which has already been used for cooling the first platform 62 can be directly conducted out of the blade/vane aerofoil 2 through the efflux duct 8.

The cooling medium K supplied to the incident flow ducts 6, 32 leaves these incident flow ducts 6, 32 either through outlet openings 12, 70 in walls 14, 72 facing toward wall inner surfaces 16, 36, which have to be cooled, of the blade/vane aerofoil 2 or through transitions 74, 76 to a cooling chamber 78 of the second platform 64, which transitions 74, 76 are provided on ends of the incident flow ducts 6, 32 remote from the respective inlet area for cooling medium K. The cooling medium K, which passes through the outlet openings 12, 70, is conducted in a transverse direction Q along wall inner surfaces 16, 36, which have to be cooled and which have ribs 20, 80, of the blade/vane aerofoil 2; it then enters the efflux duct 8 and leaves, via the latter, the blade/vane aerofoil 2 at its cooling medium efflux end BS.

The cooling chambers 68, 78 of the platforms 62, 64 are cast into the latter and are closed toward the outside by respective cover panels 82, 84. In addition, the cooling chambers 68, 78 are respectively provided, in their floor region, with an impingement cooling panel 90, 92, which is arranged at a distance from the chamber floors 86, 88. There is an efflux space 94, which is bounded by the chamber floor 86 and impingement cooling panel 90 and which is joined to the efflux duct 8, in the cooling chamber 68 of the first platform 62. On the other hand, the cooling chamber 78 of the second platform 64 has an incident flow space 96, which is bounded by the cover panel 84 and the impingement cooling panel 92 and is joined to the incident flow ducts 6, 32. In this way, the incident flow space 96 can be fed by the incident flow ducts 6, 32, which are separated from the efflux duct 8 by walls 10, 98.

List of designations

| | |
|---|---|
| 1 | Turbine blade/vane |
| 2 | Blade/vane aerofoil |
| 4 | Blade/vane axis |
| 6 | Incident flow duct for cooling medium |
| 8 | Efflux duct for cooling medium |
| 10 | Wall |
| 12 | Outlet opening |
| 14 | Wall |
| 16 | Wall inner surface |
| 18 | Transfer duct |
| 20 | Rib |
| 22 | Wall inner surface |
| 24, 26 | Wall |
| 28, 30 | Transfer duct |
| 32 | Incident flow duct for cooling medium |
| 34 | Inlet area of incident flow duct |
| 36 | Wall inner surface |
| 38 | Inlet area of incident flow duct |
| 40, 42 | Free cross section of incident flow duct |
| 44, 46 | End of incident flow duct |
| 48 | Outlet area of efflux duct |
| 50 | Beginning of efflux duct |
| 52 | Free cross section of efflux duct |
| 54, 56, 58, 60 | Recess |
| 62, 64 | Platform |
| 66 | Cover panel |
| 68 | Cooling chamber |
| 70 | Outlet opening |
| 72 | Wall |
| 74, 76 | Transition |
| 78 | Cooling chamber |
| 80 | Rib |
| 82, 84 | Cover panel |
| 86, 88 | Chamber floor |
| 90, 92 | Impingement cooling panel |
| 94 | Efflux space |
| 96 | Incident flow space |
| 98 | Wall |
| AS | Cooling medium incident flow end of blade/vane aerofoil |
| BS | Cooling medium efflux end of blade/vane aerofoil |
| K | Cooling medium |
| 1 | Length |
| L | Longitudinal direction of blade/vane aerofoil |
| Q | Transverse direction of blade/vane aerofoil |

The invention being thus described, it will be obvious that the same may be varied in may ways. Such variations are not to be regarded as a departure from the spirit and scope of the invention, and all such modifications as would be obvious to one skilled in the art are intended to be included within the scope of the following claims.

What is claimed is:

1. A turbine blade/vane comprising:

a blade/vane aerofoil which extends along a blade/vane axis and through which a cooling medium can flow, mainly in the longitudinal direction of the turbine blade/vane;

an incident flow duct and an efflux duct for the cooling medium, routed within the blade/vane aerofoil, essentially over its complete length, wherein the incident flow duct and the efflux duct are connected together on the cooling medium side such that the cooling medium passing from the incident flow duct into the efflux duct is conducted in a transverse direction along a wall inner surface, which has to be cooled, of the blade/vane aerofoil.

2. The turbine blade/vane as claimed in claim 1, wherein the incident flow duct includes outlet openings for the cooling medium, approximately uniformly distributed over the length of the turbine blade/vane and facing toward the wall inner surface, which has to be cooled, of the blade/vane aerofoil.

3. The turbine blade/vane as claimed in claim 1, wherein the free cross section of the incident flow duct in the blade/vane aerofoil decreases in a longitudinal direction of the aerofoil.

4. The turbine blade/vane as claimed in claim 3, wherein a free cross section of the incident flow duct in the blade/vane aerofoil decreases linearly in the longitudinal direction of the aerofoil.

5. The turbine blade/vane as claimed in claim 4, wherein a free cross section of the efflux duct in the blade/vane aerofoil increases in the longitudinal direction of the aerofoil to correspond with the decrease in the free cross section of the incident flow duct.

6. The turbine blade/vane as claimed in claim 1, wherein at least one of the incident flow duct and the efflux duct includes a triangular cross section parallel to the longitudinal direction of the blade/vane aerofoil and at right angles to the wall inner surface, which has to be cooled, of the blade/vane aerofoil.

7. The turbine blade/vane as claimed in claim 1, wherein a second incident flow duct for cooling medium for cooling a further wall inner surface of the blade/vane aerofoil is arranged symmetrically, with respect to the blade/vane axis, relative to the first incident flow duct.

8. The turbine blade/vane as claimed in claim 7, wherein the first incident flow duct and the second incident flow duct open into a common efflux duct for cooling medium.

9. The turbine blade/vane as claimed in claim 1, wherein a wall inner surface, which has to be cooled, of the blade/vane aerofoil is respectively provided with ribs, arranged transversely to the blade/vane axis, which guide the cooling medium.

10. The turbine blade/vane as claimed in claim 1, wherein at least one of the incident flow duct is closed at its end remote from an inlet area for cooling medium, and the efflux duct is closed at its beginning remote from an outlet area for cooling medium.

11. The turbine blade/vane as claimed in claim 1, further comprising:

a platform, extending transversely to the blade/vane axis, formed on the blade/vane aerofoil at its cooling medium efflux end, wherein the platform includes a cooling chamber joined to the incident flow duct and to which cooling medium can be admitted.

12. The turbine blade/vane as claimed in claim 1, further comprising:

a platform, extending transversely to the blade/vane axis, formed on the blade/vane aerofoil at its cooling medium incident flow end, wherein the platform includes a cooling chamber joined to the efflux duct and to which cooling medium can be admitted.

13. The turbine blade/vane as claimed in claim 11, wherein a cooling chamber is cast into the platform and is closed toward the outside by a cover panel.

14. The turbine blade/vane as claimed in claim 13, wherein the cooling chamber is provided, in a floor area, with an impingement cooling panel arranged at a distance from the chamber floor.

15. The turbine blade/vane as claimed in claim 14, wherein an efflux space of the cooling chamber, bounded by the chamber floor and the impingement cooling panel, is joined to the efflux duct.

16. The turbine blade/vane as claimed in claim 14, wherein an incident flow space of the cooling chamber, bounded by the cover panel and the impingement cooling panel, is joined to the incident flow duct.

17. The turbine blade/vane as claimed in claim 1, configured as a guide vane for a gas turbine.

18. The turbine blade/vane as claimed in claim 2, wherein the free cross section of the incident flow duct in the blade/vane aerofoil decreases in a longitudinal direction of the aerofoil.

19. The turbine blade/vane as claimed in claim 3, wherein a free cross section of the efflux duct in the blade/vane aerofoil increases in the longitudinal direction of the aerofoil.

20. The turbine blade/vane as claimed in claim 2, wherein at least one of the incident flow duct and the efflux duct includes a triangular cross section parallel to the longitudinal direction of the blade/vane aerofoil and at right angles to the wall inner surface, which has to be cooled, of the blade/vane aerofoil.

21. The turbine blade/vane as claimed in claim 3, wherein at least one of the incident flow duct and the efflux duct includes a triangular cross section parallel to the longitudinal direction of the blade/vane aerofoil and at right angles to the wall inner surface, which has to be cooled, of the blade/vane aerofoil.

22. The turbine blade/vane as claimed in claim 2, wherein a second incident flow duct for cooling medium for cooling a further wall inner surface of the blade/vane aerofoil is arranged symmetrically, with respect to the blade/vane axis, relative to the first incident flow duct.

23. The turbine blade/vane as claimed in claim 22, wherein the first incident flow duct and the second incident flow duct open into a common efflux duct for cooling medium.

24. The turbine blade/vane as claimed in claim 3, wherein a second incident flow duct for cooling medium for cooling a further wall inner surface of the blade/vane aerofoil is arranged symmetrically, with respect to the blade/vane axis, relative to the first incident flow duct.

25. The turbine blade/vane as claimed in claim 24, wherein the first incident flow duct and the second incident flow duct open into a common efflux duct for cooling medium.

26. The turbine blade/vane as claimed in claim 2, wherein a wall inner surface, which has to be cooled, of the blade/vane aerofoil is respectively provided with ribs, arranged transversely to the blade/vane axis, which guide the cooling medium.

27. The turbine blade/vane as claimed in claim 3, wherein a wall inner surface, which has to be cooled, of the blade/vane aerofoil is respectively provided with ribs, arranged transversely to the blade/vane axis, which guide the cooling medium.

28. The turbine blade/vane as claimed in claim 2, wherein at least one of the incident flow duct is closed at its end remote from an inlet area for cooling medium, and the efflux duct is closed at its beginning remote from an outlet area for cooling medium.

29. The turbine blade/vane as claimed in claim 11, further comprising:

a second platform, extending transversely to the blade/vane axis, formed on the blade/vane aerofoil at its cooling medium incident flow end, wherein the second platform includes a cooling chamber joined to the efflux duct and to which cooling medium can be admitted.

30. A gas turbine, comprising:

a turbine blade/vane including, a blade/vane aerofoil which extends along a blade/vane axis and through which a cooling medium can flow, mainly in the longitudinal direction of the turbine blade/vane, and an incident flow duct and an efflux duct for the cooling medium, routed within the blade/vane aerofoil, essentially over its complete length, wherein the incident flow duct and the efflux duct are connected together on the cooling medium side such that the cooling medium passing from the incident flow duct into the efflux duct is conducted in a transverse direction along a wall inner surface, which has to be cooled, of the blade/vane aerofoil.

* * * * *